US005871390A

United States Patent [19]

Pant et al.

[11] Patent Number: 5,871,390

[45] **Date of Patent: *Feb. 16, 1999**

[54] METHOD AND APPARATUS FOR ALIGNING AND TENSIONING A PAD/BELT USED IN LINEAR PLANARIZATION FOR CHEMICAL MECHANICAL POLISHING

[75] Inventors: Anil K. Pant, Santa Cruz; Douglas W. Young, Sunnyvale, both of Calif.; Joseph R. Breivogel, Aloha, Oreg.; Konstantin Volodarski, San Francisco; Leon Volfovski, Mountain View, both of Calif.

[73] Assignee: Lam Research Corporation, Fremont, Calif.

[ * ] Notice: The term of this patent shall not extend beyond the expiration date of Pat. No. 5,692,947.

[21] Appl. No.: 795,880

[22] Filed: Feb. 6, 1997

[51] Int. Cl.[6] ..... B24B 21/20

[52] U.S. Cl. ..... 451/5; 451/41; 451/311; 451/499; 451/289

[58] Field of Search ..... 451/5, 311, 297, 451/499, 285–289

[56] References Cited

U.S. PATENT DOCUMENTS

| | | | |
|---|---|---|---|
| 3,504,458 | 4/1970 | Rutt | 451/297 |
| 3,552,067 | 1/1971 | Przgocki | 451/297 |
| 3,745,717 | 7/1973 | Robinson | 451/297 |
| 4,187,645 | 2/1980 | Lind | 451/297 |
| 4,290,240 | 9/1981 | Robinson | 451/297 |
| 4,337,598 | 7/1982 | Barth et al. | 451/297 |
| 4,369,601 | 1/1983 | Gerber | 451/297 |
| 5,184,424 | 2/1993 | Miller | 451/297 |
| 5,692,947 | 12/1997 | Talieh et al. | 451/41 |

FOREIGN PATENT DOCUMENTS

| | | | |
|---|---|---|---|
| 361125766 | 6/1986 | Japan | 451/311 |
| 271780 | 5/1970 | U.S.S.R. | 451/297 |

*Primary Examiner*—Robert A. Rose
*Assistant Examiner*—George Nguyen
*Attorney, Agent, or Firm*—Kidd & Booth

[57] ABSTRACT

The present invention describes an apparatus and method for aligning a pad/belt on a roller for use in chemical mechanical polishing using linear planarization. The present invention comprises an alignment sensor that senses the alignment of the pad/belt. The present invention additionally comprises a tensioner that tensions the pad/belt on the roller. And, a controller that controls the alignment of the pad/belt on the roller by controlling the tensioner.

26 Claims, 6 Drawing Sheets

METHOD AND APPARATUS FOR ALIGNING AND TENSIONING A PAD/BELT USED IN LINEAR PLANARIZATION FOR CHEMICAL MECHANICAL POLISHING

BACKGROUND OF THE INVENTION

1. Field of the Invention

The present invention relates to the field of semiconductor wafer processing using a linear polisher for chemical mechanical polishing of the semiconductor wafers. More particularly, the present invention relates to aligning a linearly moving pad and belt combination on a roller used in the linear polisher.

2. Description of the Related Art

The manufacture of an integrated circuit device requires the formation of various layers (both conductive and non-conductive) above a base substrate to form components and interconnects. During the manufacturing process, it is often necessary to remove a certain layer or portions of a layer in order to pattern and form the various components and interconnects. Chemical mechanical polishing (CMP) is one technique for planarizing a surface of a semiconductor wafer, such as a silicon wafer, at various stages of integrated circuit processing. Other uses of CMP include planarizing optical surfaces, metrology samples, and various metal and semiconductor based substrates.

CMP typically uses a chemical slurry along with a polishing pad to polish away the specified materials or layers on a semiconductor wafer. The mechanical movement of the pad relative to the wafer in combination with the chemical reaction of the slurry disposed between the wafer and the pad provide the abrasive force with chemical erosion necessary to polish the exposed surface of the wafer (or a layer formed on the wafer) when subjected to a force pressing the wafer to the pad. In the most common method of performing CMP, a substrate mounted on a polishing head rotates against a polishing pad placed on a rotating table (see, e.g., U.S. Pat. No. 5,329,732). The mechanical force for polishing comes from the rotating table speed and the downward force on the head while the chemical slurry constantly flows under the polishing head. Rotation of the polishing head helps in the slurry delivery as well as in averaging the polishing rates across the substrate surface.

One technique for obtaining a more uniform chemical mechanical polishing rate is to utilize a linear polisher. Instead of a rotating pad, a belt with a coupled pad moves linearly across the wafer surface. It is still necessary to rotate the wafer for averaging out the local variations; however, the linear polisher has a better global planarity over CMP tools using rotating pads. One example of a linear polisher is described in a pending application titled "Linear Polisher And Method For Semiconductor Wafer Planarization;" Ser. No. 08/287,658; filed Aug. 9, 1994.

A major problem with using a linear polishing tool for CMP is keeping the pad/belt combination (hereafter simply "pad/belt") aligned on the rollers. FIG. 1 illustrates a prior art linear polishing tool 10 with a pad/belt 15. The polishing tool 10 comprises the spindles, 13 and 14. Coupled to each spindle are the rollers 32 and 34, and coupled to each roller are the roller pads 33 and 35. The alignment of the pad/belt on the rollers is very important in the uniformity of the wafer polishing. A small variation (or tolerance) in the alignment of the pad/belt on the rollers is acceptable and is currently about 1/16 inch or less, although the tolerance may increase or decrease due to a number of factors. A variation greater than the allowed tolerance, however, will produce an uneven planarization of the wafer, which could produce inoperable devices from the wafer (resulting in low die yields from the wafer). A larger variation in the alignment could even cause the pad/belt to miss or not planarize parts of a wafer. And in a worst case situation, a very large variation in the alignment could even cause the pad/belt to come off of the rollers, producing disastrous consequences to the semiconductor wafer and the tool itself.

A pad/belt generally will self align only when a number of factors are met. Some of these factors include the following: the spindles and rollers are perfectly parallel to each other, the pad/belt is perfectly flat (that is the pad/belt has no arch or sag in the middle of the pad/belt), and the circumference of both sides of the pad/belt are the same. Unfortunately, these factors are difficult to meet due to a variety of other factors including: the manufacturing of the pad and the belt and coupling them together, the high linear operating speed of the pad/belt, and the various forces applied to the pad/belt during the planarization process of the wafer. One example is the large shear and tensional forces applied to the pad/belt by the rotating polishing head with the attached wafer. Another example occurs during the manufacturing of the pad and or the belt that may introduce small variations into their respective surfaces or in their respective circumferences. And, another example is during the coupling of the pad to the belt if the respective circumferences are not within tolerance. The present invention overcomes the above problems by disclosing an apparatus and method for aligning a pad/belt on a roller used in a linear polishing tool used in CMP.

SUMMARY OF THE INVENTION

The present invention describes an apparatus and method for aligning a pad/belt on a roller used in linear planarization for chemical mechanical polishing. The present invention comprises an alignment sensor that senses the alignment of the pad/belt. A tensioner tensions the pad/belt on a roller. And, a controller controls the alignment of the pad/belt by controlling the tensioner.

One embodiment of the present invention comprises an electro-mechanical control system. A second embodiment of the present invention comprises a hydraulic control system. And, a third embodiment of the present invention comprises a pneumatic control system.

DETAILED DESCRIPTION OF THE INVENTION

The present invention describes an apparatus and method for aligning a pad and belt combination on a roller used in linear planarization for chemical mechanical polishing. The following description sets out specific details such as specific structures, polishing techniques, components, etc. to provide a thorough understanding of the invention. However, one skilled in the art will appreciate that they may practice the present invention without these specific details. In other instances, this description does not describe well known techniques and structures in detail in order not to obscure the present invention. Although this disclosure describes the present invention in reference to performing chemical mechanical polishing on a semiconductor wafer, the present invention is readily adaptable to polish other materials including glass or substrates for the manufacture of flat panel displays, and planarizing optical surfaces.

Figure 1:
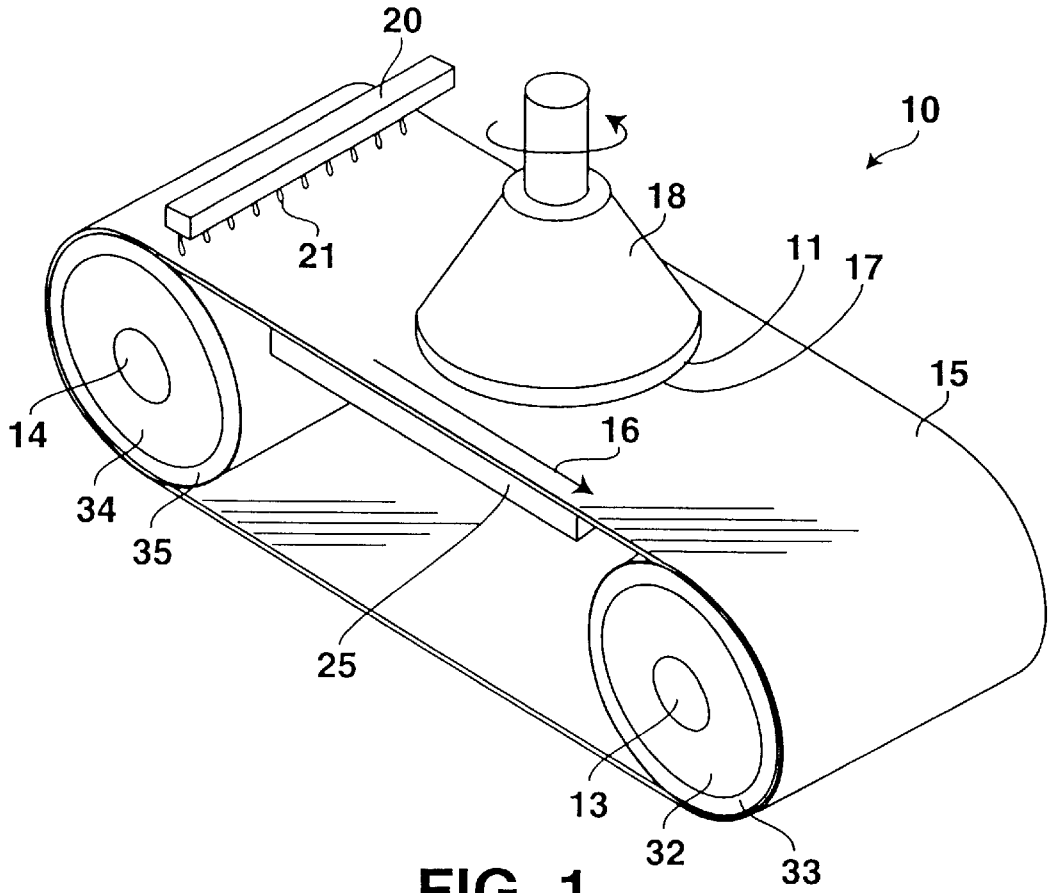
FIG. 1 is a pictorial illustration of a linear polishing tool in the prior art.
Figure 2:
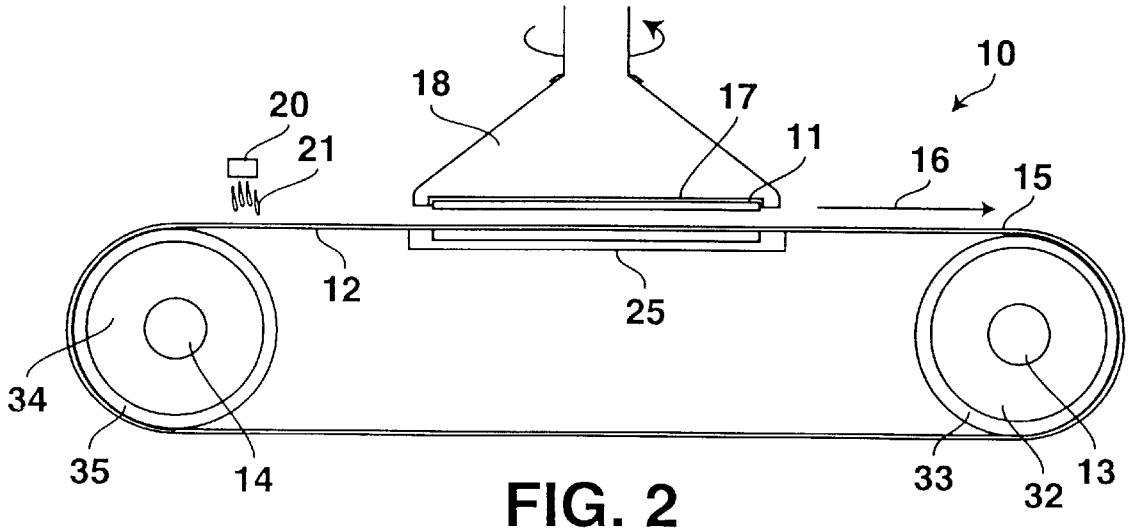
FIG. 2 is a cross-sectional diagram of the linear polishing tool of FIG. 1.

FIGS. 1 and 2 show a linear polishing tool 10 in current practice. An example of a linear polishing tool is in the pending patent application titled "Linear Polisher And Method For Semiconductor Wafer Planarization." The linear polishing tool 10 polishes away materials on the surface of a semiconductor wafer 11. The removed material can be the substrate material of the wafer itself or one of the layers formed on the substrate. Such formed layers include dielectric materials (such as silicon dioxide or silicon nitride), metals (such as aluminum, copper, or tungsten), metal alloys or semiconductor materials (such as silicon or polysilicon). More specifically, the linear polishing tool 10 uses a polishing technique known as chemical mechanical polishing (CMP) to polish or remove one or more of these layers fabricated on the wafer 11 in order to planarize the surface layer.

The linear polishing tool 10 utilizes a pad with a coupled belt (hereafter the pad and belt are simply "pad/belt") 15 that moves linearly with respect to the surface of wafer 11. The pad/belt 15 is a continuous pad/belt rotating about a drive spindle 13 and an idle spindle 14. A driving means, such as an electric motor, applies a rotational motion to spindle 13 that causes pad/belt 15 to move in a linear motion with respect to the wafer 11 as shown by direction arrow 16. Spindle 13 couples to the frame of the tool 10, while spindle 14 pivotally couples to the frame of tool 10. Coupled to each spindle are the rollers 32 and 34, where each roller typically comprises a stainless steel cylinder, which generally comprises a diameter of around 12 inches. Although the present invention uses stainless steel for the rollers, other materials are suitable as well including a stainless steel covered metal. And although the present invention generally uses a roller with a diameter of around 12 inches, other diameters for the rollers are suitable as well. Additionally, both rollers further comprise the roller pads 33 and 35, with each roller pad being approximately 0.5" of rubber, although other materials and thickness's are suitable for use as well. The length of rollers 32 and 34 (with their respective roller pads) are generally the same as the width of the pad/belt 15, which is typically 12 inches to 14 inches.

The wafer 11 is made to reside within a wafer carrier 17, which is part of a housing 18. The wafer 11 is held in position by a mechanical retaining means (such as a retainer ring) and/or by a vacuum. The wafer carrier 17 positions the wafer atop pad/belt 15 so that the surface of the wafer comes in contact with the pad portion of pad/belt 15. The housing 18 rotates in order to rotate the wafer 11. The rotation of the wafer 11 provides the averaging for the planarization of the polishing contact with the wafer surface.

The linear polishing tool 10 additionally contains a slurry dispensing mechanism 20, which dispenses a slurry 21 onto pad/belt 15. The slurry 21 is necessary for proper CMP of the wafer 11. The linear polishing tool 10 also includes a platen 25 disposed on the underside of pad/belt 15 and opposite from carrier 17 such that pad/belt 15 resides between platen 25 and wafer 11. One purpose of platen 25 is to provide a supporting platform on the underside of pad/belt 15 to ensure that the polishing surface of the pad makes sufficient contact with wafer 11 for uniform polishing. Typically, the carrier 17 is pressed downward against pad/belt 15 with appropriate force, so that wafer 11 makes sufficient contact with the contact surface of the pad for performing CMP. Since the pad/belt 15 is flexible and will depress when the wafer is pressed downward onto it, platen 25 provides a necessary counteracting force to this downward force.

Although platen 25 can be of a solid platform, a preference is to have platen 25 function as a type of fluid bearing for the practice of the present invention. One example of a fluid bearing is described in a pending U.S. Patent application titled "Wafer Polishing Machine With Fluid Bearings;" Ser. No. 08/333,463; filed Nov. 2, 1994, which describes fluid bearings having pressurized fluid directed against the polishing pad.

Figure 3:
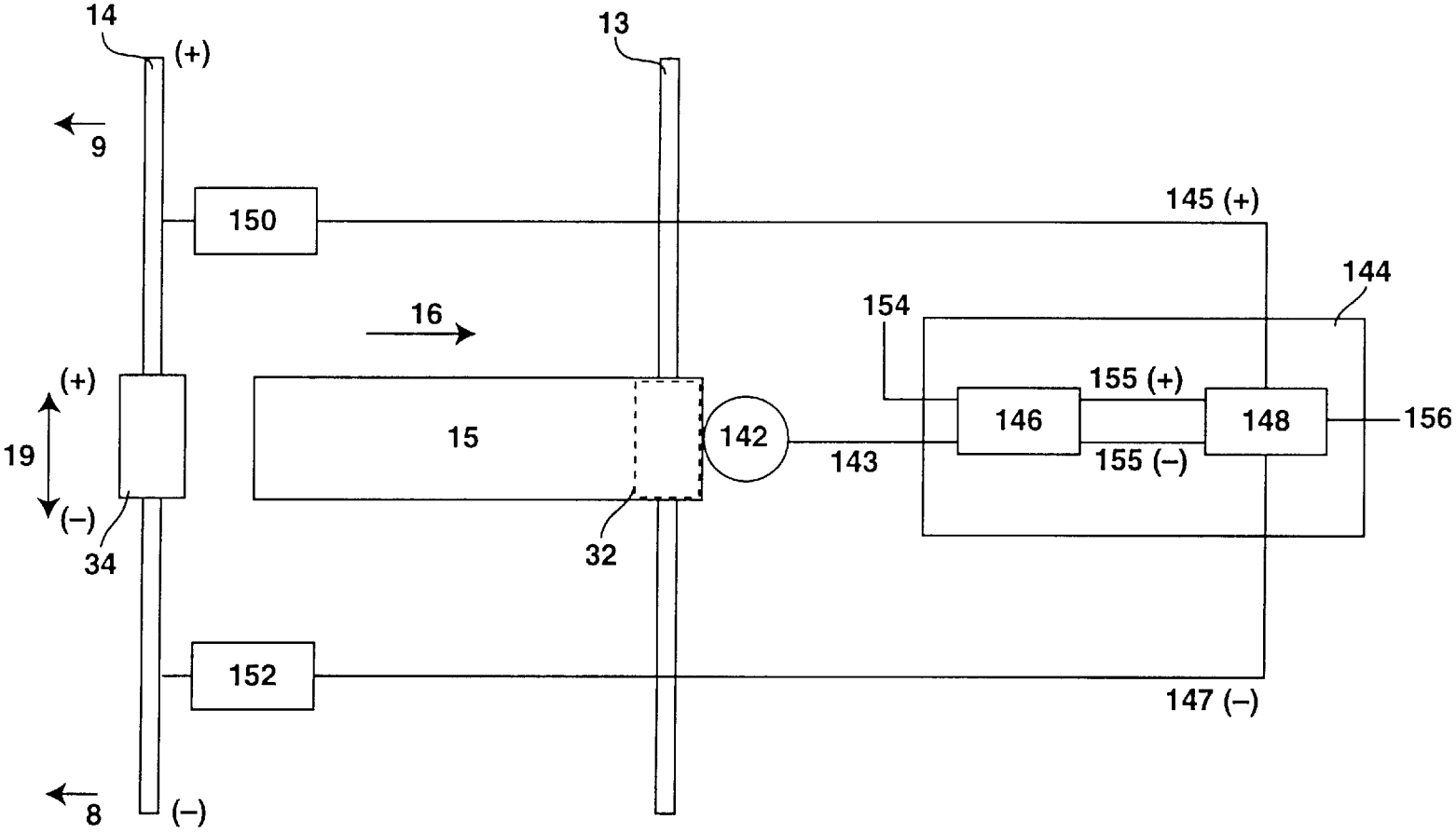
FIG. 3 is a block diagram of the present invention.

FIG. 3 is a block diagram of the present invention, which describes an apparatus and method for aligning a pad/belt 15 on a drive roller 32 and an idle roller 34. Coupled within drive roller 32 is a drive spindle 13, and coupled within idle roller 34 is an idle spindle 14. Coupled to each roller are the roller pads 33 and 35 as shown in FIGS. 1 and 2. The pad/belt 15 is a continuous pad/belt rotating about drive spindle 13 and idle spindle 14 and their respective rollers 32 and 34. A driving means, such as an electric motor, applies a rotational motion to drive spindle 13 that causes pad/belt 15 to move in a linear motion as shown by direction arrow 16. Due to a variety of factors as previously mentioned, pad/belt 15 will get out of alignment from the rollers and will move or shift in a direction 19 (+) or (−), which is a direction tangential or perpendicular to the direction 16 of linear motion. To keep the pad/belt 15 on rollers 32 and 34, the present invention comprises an alignment sensor 142 that senses or monitors the alignment of pad/belt 15 on roller 32 of drive spindle 13. The alignment sensor sends an alignment signal 143 to a controller 144. Controller 144 further comprises an alignment subsystem 146 and a tensioning subsystem 148. The alignment subsystem 146 receives the alignment signal 143 and compares it to an alignment set point 154, which is a signal that informs controller 144 when pad/belt 15 is in alignment.

When the alignment subsystem 146 determines that pad/belt is out of alignment, it sends an out of alignment signal 155 (+) or (−) to the tensioning subsystem 148. The symbols (+) or (−) are a convention to help in describing the present invention. The out of alignment signals 155 (+) or (−) inform the tensioning subsystem the direction that the pad/belt 15 went out of alignment. If pad/belt 15 is out of alignment in direction 19 (+), the alignment subsystem 146 will send the out of alignment signal 155 (+) to the tensioning subsystem 148. The tensioning subsystem 148 will generate a tensioning signal 145 (+) to a tensioner 150. The tensioner 150 will increase the tension on pad/belt 15 by applying an additional force to the (+) end of pivotally mounted idle spindle 14, moving this end of idle spindle 14 in direction 9, which increases the tension of pad/belt 15 on roller 34. Increasing tension on spindle 14 in direction 9 will force the pad/belt 15 to move or shift in direction 19 (−) to get back into alignment with rollers 32 and 34.

In a similar manner, if pad/belt 15 is out of alignment in direction 19 (−), the alignment subsystem 146 will send the out of alignment signal 155 (−) to the tensioning subsystem 148. The tensioning subsystem 148 will generate a tensioning signal 147 (–) to a tensioner 152. The tensioner 152 will increase the tension on pad/belt 15 by applying an additional force to the (–) end of pivotally mounted idle spindle 14, moving this end of idle spindle 14 in direction 8, which increases the tension of pad/belt 15 on roller 34. Increasing tension on spindle 14 in direction 8 will force the pad/belt 15 to move or shift in direction 19 (+) to get back into alignment with rollers 32 and 34.

The tension subsystem 148 will use a tension set point 156 as the initial or base tension for the tensioners 150 and 152 to apply to spindle 14. The present invention may further comprise an open loop or closed loop control system for controlling the amount additional force or tension that the tensioners 150 and 152 apply to spindle 14. When using a closed loop control system for the additional tensioning, the tension subsystem 148 will receive a tension set point 156 and compare it to a feedback signal from the appropriate tensioner to determine the appropriate tension to apply to spindle 14.

Figure 4A:
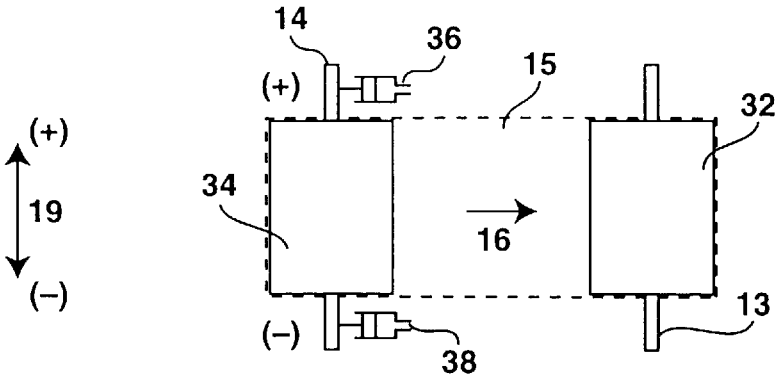
FIG. 4 is a top down perspective illustrating the relationship between the alignment of a pad/belt and the tensioning of a roller.
Figure 4B:
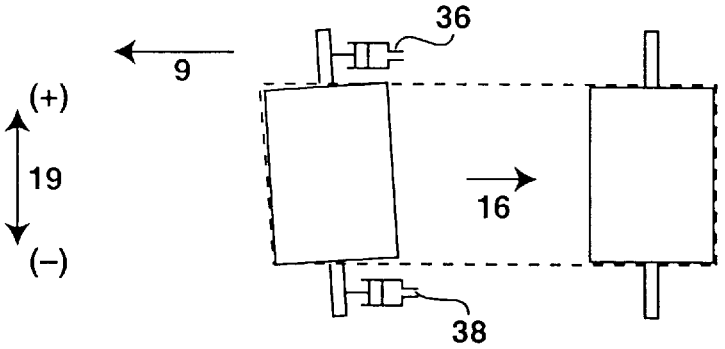
Figure 4C:
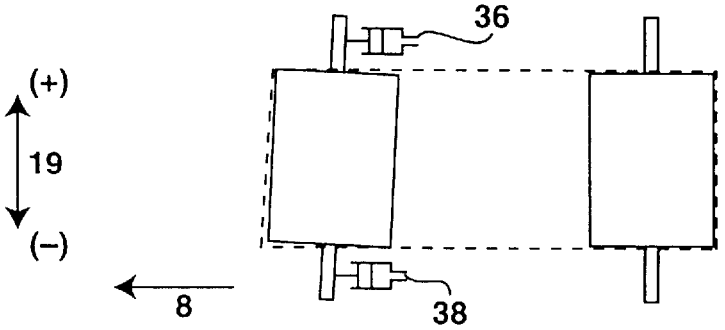

FIGS. 4A, 4B, and 4C illustrate the operation of the present invention with a top view showing the drive spindle 13 with roller 32, the idle spindle 14 with roller 34, and pad/belt 15 moving in a linear direction 16, and tensioners 36 and 38. Tangential direction 19 (+) or 19 (–) are the directions that the pad/belt will move to or shift to when going out of alignment with the rollers. To help visualize the present invention, which aligns pad/belt 15 on rollers 32 and 34, a person would view roller 34 in the direction of linear motion of pad/belt 15 with roller 32 in the background. The alignment of the present invention is then keeping pad/belt 15 in a straight line with and on rollers 32 and 34.

One purpose in maintaining the pad/belt alignment, as previously mentioned, is to keep the linear polishing tool producing an even planarization of the wafer. The present invention achieves this goal by pivotally moving the idle spindle 14 with respect to the drive spindle 13 in such a way that it creates a path of least resistance in the opposite tangential direction to the direction that the pad/belt is moving to or shifting to when going out of alignment.

FIG. 4B and FIG. 4C illustrate the above operation in the following manner. FIG. 4B shows the pad/belt 15 going out of alignment in direction 19(+). Tensioner 36 applies an additional force on the (+) end of spindle 14 in direction 9 in a manner as described above, which increases the tension of pad/belt 15 on roller 34. The path of least resistance for the pad/belt 15 to move is in the 19(–) direction; and therefore, the pad/belt 15 comes back into alignment when it moves in the 19(–) direction. Likewise, FIG. 4C shows the pad/belt 15 going out of alignment in direction 19(–). Tensioner 38 applies an additional force on the (–) end of spindle 14 in direction 8 in a manner as described above, which increases the tension of pad/belt 15 on roller 34. The path of least resistance for the pad/belt 15 to move is in the 19(+) direction; and therefore, the pad/belt 15 comes back into alignment when it moves in the 19(+) direction.

Figure 5:
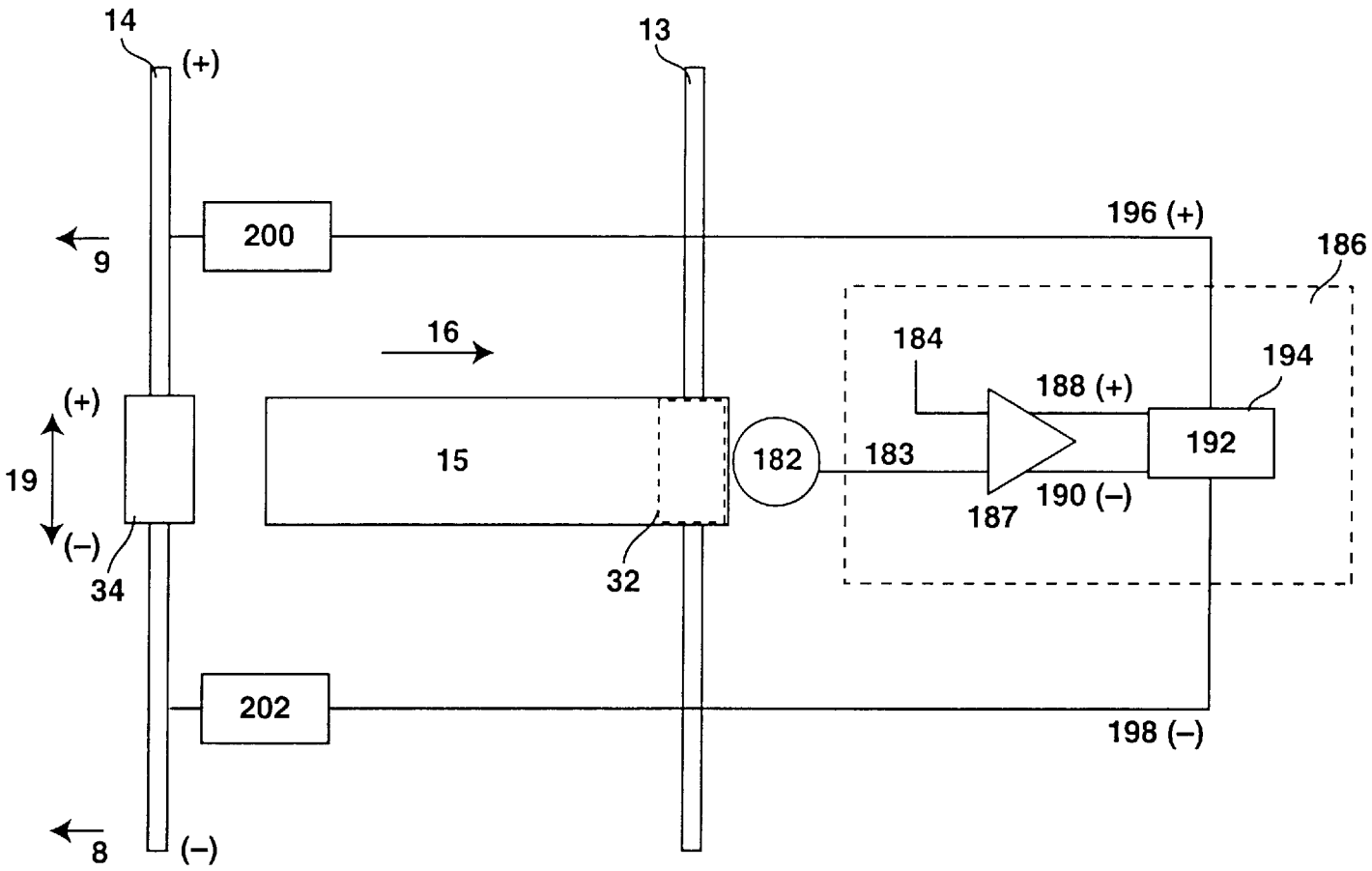
FIG. 5 is a block diagram of a first embodiment of the present invention using an electromechanical control system.

FIG. 5 is a block diagram of one embodiment of the present invention that uses an electromechanical control system for aligning a pad/belt 15 on a drive spindle 13 and an idle spindle 14. Coupled to drive spindle 13 is a roller 32, and coupled to idle spindle 14 is a roller 34. Coupled to each roller are the roller pads 33 and 35 as shown in FIGS. 1 and 2. Pad/belt 15 moves in a linear motion as shown by direction arrow 16. To keep the pad/belt 15 on rollers 32 and 34, the present invention comprises an alignment sensor 182 that senses or monitors the alignment of pad/belt 15 on roller 32 of drive spindle 13. The alignment sensor 182 comprises an inductively coupled sensor for use with a stainless steel or metallic type belt for pad/belt 15. The inductively coupled sensor senses the change in the inductance as the metallic belt goes off of an edge of roller 32. Although the preferred embodiment of the present invention uses an inductively coupled sensor, other types of sensors are also suitable including a wide beam laser sensor, a video (camera) sensor, or an infrared sensor. These other types of sensors generally sense or monitor the edges of the roller 32 for when the pad/belt goes off of one of the edges of the pad/belt 15. An advantage to these other types of sensors is that they are suitable for use with both metal and non-metal belts used in the pad/belt 15.

The alignment sensor sends an alignment signal 183 to a controller 186. Controller 186 further comprises an alignment sub-system 187 and a tensioning subystem 192. The preferred embodiments of alignment sub-system 187 and tensioning subsystem 192 comprise comparators or systems able to compare multiple signals. Although the preferred embodiment comprises comparators, other types of devices or systems capable of comparing signals are suitable for use as well, including microprocessor based control systems.

The alignment subsystem 187 receives the alignment signal 183 and compares it to an alignment set point 184, which is a signal that informs controller 186 when pad/belt 15 is in alignment. When the alignment subsystem 187 determines that pad/belt 15 is out of alignment, it sends an out of alignment signal 188 (+) or 190 (–) to the tensioning sub-system 192. The out of alignment signals 188 (+) or 190 (–) inform the tensioning sub-system the direction that the pad/belt 15 went out of alignment. The tensioning subsystem 192 additionally receives the tension set point 194, which the tensioning subsystem 192 uses to determine the initial or base tension that the tensioner's, 200 and 202, apply to idle spindle 14. The tensioners 200 and 202 further comprise an electric stepper motor with a lead screw mechanism or some similar type of adjustable screw mechanism.

If pad/belt 15 is out of alignment in direction 19 (+), the alignment subsystem 187 will send the out of alignment signal 188 (+) to the tensioning subsystem 192. The tensioning subsystem 192 will generate a tensioning signal 196 (+) to a tensioner 200. The tensioner 200 will increase the tension on pad/belt 15 by applying an additional force to the (+) end of pivotally mounted idle spindle 14, moving this end of idle spindle 14 in direction 9, which increases the tension of pad/belt 15 on roller 34. Increasing tension on spindle 14 in direction 9 will force the pad/belt 15 to move or shift in direction 19 (–) to get back into alignment with rollers 32 and 34.

In a similar manner, if pad/belt 15 is out of alignment in direction 19 (–), the alignment subsystem 187 will send the out of alignment signal 190 (–) to the tensioning subsystem 192. The tensioning subsystem 192 will generate a tensioning signal 198 (–) to a tensioner 202. The tensioner 202 will increase the tension on pad/belt 15 by applying an additional force to the (–) end of pivotally mounted idle spindle 14, moving this end of idle spindle 14 in direction 8, which increases the tension of pad/belt 15 on roller 34. Increasing tension on spindle 14 in direction 8 will force the pad/belt 15 to move or shift in direction 19 (+) to get back into alignment with rollers 32 and 34.

Figure 6:
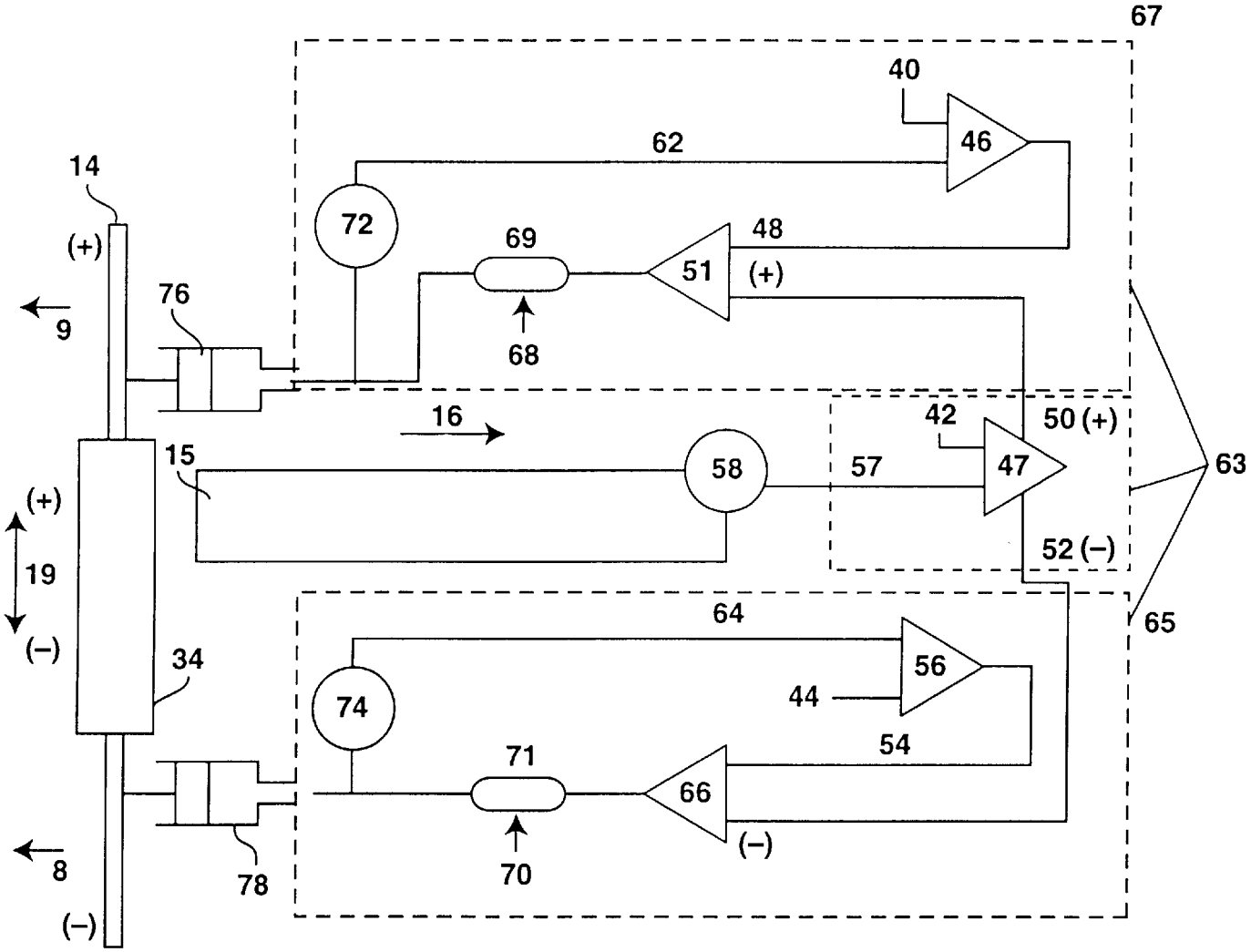
FIG. 6 is a block diagram of a second embodiment of the present invention using a hydraulic control system.

FIG. 6 illustrates a second embodiment of the present invention that uses a hydraulic control system with a closed loop control system for tensioning. An alignment set point 42 for a pad/belt 15 establishes the correct alignment of pad/belt 15 on a roller 32 (of FIG. 1) and a drive spindle 13

(of FIG. 1). An alignment sensor 58 generates an alignment signal 57 that indicates the relative position of pad/belt 15 on the roller of the drive spindle. The alignment sensor 58 sends the alignment signal 57 to a controller 63 that further comprises an alignment subsystem 47 and the tension subsystems 65 and 67. The alignment subsystem 47 compares the alignment signal 57 to the alignment set point 42. The alignment subsystem 47 will generate an out of alignment signal, 50 (+) or 52 (−), that causes the tension subsystems, 65 or 67, to generate an appropriate signal to cause the tensioners, 76 or 78, to apply additional tension to spindle 14 to move the pad/belt 15 back into alignment. Although this embodiment of the present invention comprises a comparator for the alignment subsystem, other types of devices or systems capable of comparing signals are suitable for use as an alignment controller as well, including microprocessor based control systems. Additionally this embodiment comprises a network of comparators for the tension subsystem, other types of devices or systems capable of comparing signals are suitable for use as a tension subsystem as well, including microprocessor based control systems.

The tension subsystem 65 will cause tensioner 78 to apply additional tension to spindle 14 at its end (−) when alignment subsystem 47 generates the out of alignment signal 52 (−). The tension subsystem 65 comprises a tension set point 44 that indicates the target hydraulic pressure for tensioner 78 to apply. A comparator 56 compares the tension set point 44 with a tension value signal 64 and generates a tension error signal 54, which determines whether the current tension being applied by tensioner 78 is equal to the tension set point 44. A pressure transducer 74 generates the tension value signal 64. which is the amount of tension that the tensioner 78 is applying to the spindle 14. In this embodiment, tensioner 78 comprises a hydraulic cylinder. A pressure control valve 71 supplies hydraulic pressure to tensioner 78 from a hydraulic pump 70. The pressure control valve 71 supplies the pressure on command from a signal from comparator 66, which compares the value of the position error signal 52 (−) to the value of the tension error signal 54. When the hydraulic pressure supplied to hydraulic cylinder 78 equals the pressure set by the tension set point 44, the tension subsystem 65 will stop supplying additional hydraulic pressure to the tensioner 78. The increased alignment tension or force on the (−) end of spindle 14 from the tensioner 78 will move the spindle 14 in direction 8, which increases the tension of pad/belt 15 on roller 34. The increased tension will cause the pad/belt 15 to align or track to the direction 19(+).

The other tension subsystem 67 of this embodiment of the present invention operates in a similar manner and will cause tensioner 76 to activate when the alignment subsystem 47 generates the out of alignment signal 50 (+). The tension subsystem 67 comprises a tension set point 40 to indicate when the tensioner 76 reaches the required tension set point. A comparator 46 compares the tension set point 40 with a tension value signal 62 and generates a tension error signal 48, which determines whether the current tension being applied by tensioner 76 is equal to the tension set point 40. A pressure transducer 72 generates the tension value signal 62, which is the amount of tension that the tensioner 76 is applying to spindle 14 at its (+) end. In this embodiment, the tensioner 76 is a hydraulic cylinder. A pressure control valve 69 supplies hydraulic pressure to tensioner 76 from a hydraulic pump 68. The pressure control valve 69 supplies the pressure on command from a signal from comparator 51 which compares the value of the out of alignment signal 50 (+) to the value of the tension error signal 48. When the hydraulic pressure supplied to hydraulic cylinder 76 equals the pressure set by the tension set point 40, the tension subsystem 67 will stop supplying additional hydraulic pressure to tensioner 76. The increased alignment tension or force on the (+) end of spindle 14 from the tensioner 78 will move the spindle 14 in direction 9, which increases the tension of pad/belt 15 on roller 34. The increased tension will cause the pad/belt 15 to align or track to the direction 19 (−).

Figure 7:
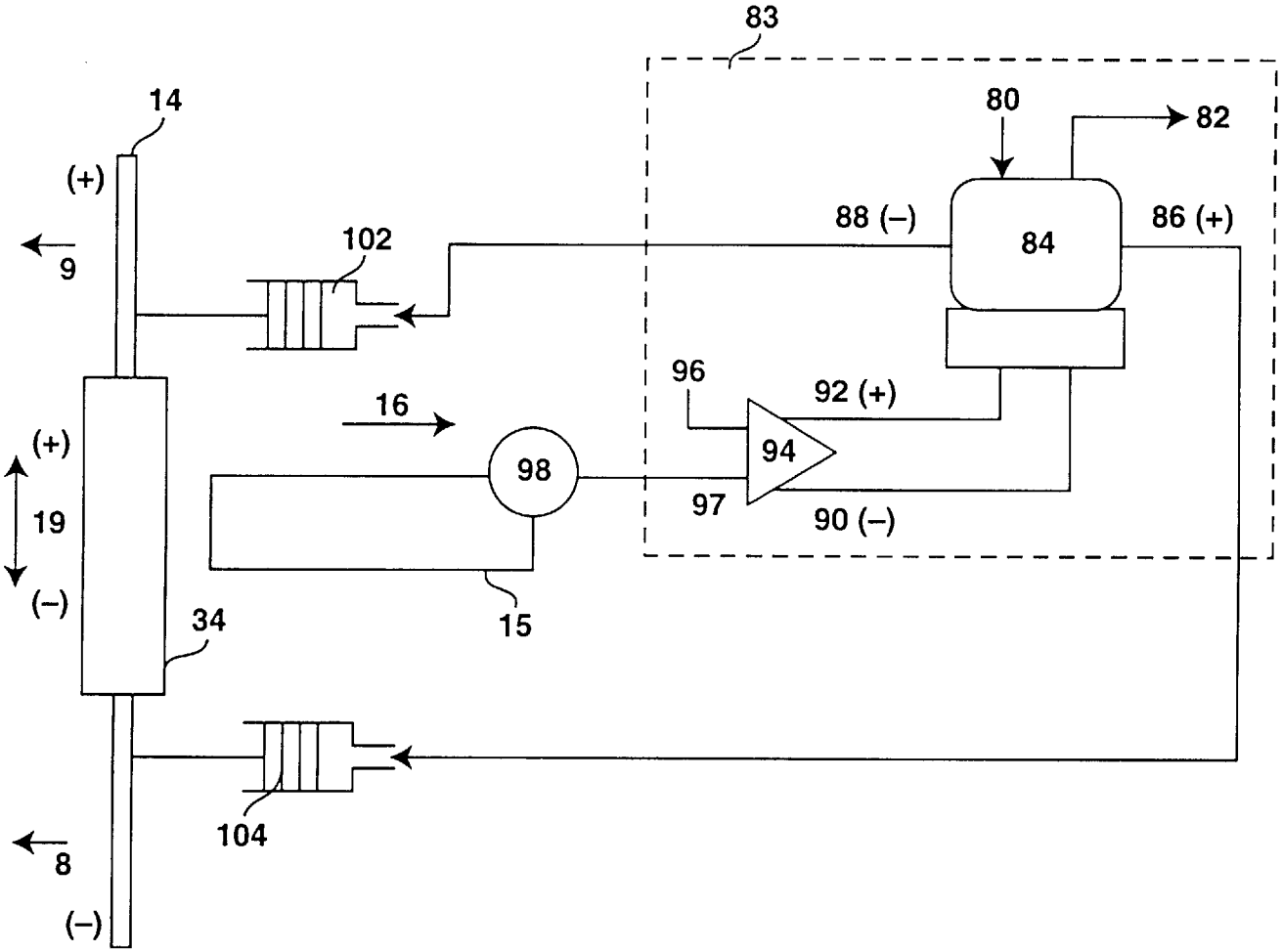
FIG. 7 is a block diagram of a third embodiment of the present invention using a pneumatic control system.

FIG. 7 discloses a third embodiment of the present invention that uses a pneumatic control system with an open control system for applying additional tension to the roller. An alignment set point 96 for a pad/belt 15 establishes the initial or base alignment for pad/belt 15. An alignment sensor 98 generates an alignment signal 97 that indicates the relative position of pad/belt 15 on a roller 32 (of FIG. 1) and a drive spindle 13 (of FIG. 1). A controller 83 monitors and controls the alignment and tensioning required to keep pad/belt 15 aligned on the rollers. The controller 83 further comprises an alignment subsystem 94 and a tension subsystem 84. The alignment subsystem 94 compares the alignment signal 97 to the alignment set point 96. The alignment subsystem 94 will generate an out of alignment signal, 90 (−) or 92 (+), that causes the tension subsystem 84 to generate a signal to cause a tensioner, 102 or 104, to apply additional tension to the spindle 14 that will move the pad/belt 15 back into alignment. Although this embodiment of the present invention comprises a comparator for the alignment subsystem 94, other types of devices or systems capable of comparing signals are suitable for use as an alignment subsystem as well, including microprocessor based controllers.

The tension subsystem 84 will cause the appropriate tensioner, 102 or 104, to apply additional tension when the alignment subsystem 94 generates an out of alignment signal 90 (−) or 92 (+). The tensioners, 102 or 104, in this embodiment comprise pneumatic cylinders. A common pneumatic air supply enters into tension subsystem 84 through an inlet 80. A common exhaust 82 allows excess air to vent into the atmosphere.

When tension subsystem 84 receives the out of alignment signal 90 (−), tension subsystem 84 will increase the air pressure through control port 88 (−) to the tensioner (pneumatic cylinder) 102. The increased tension or force on the (+) end of spindle 14 increases the tension of pad/belt 15 on roller 34 and will cause the pad/belt 15 to move or shift to the 19 (−) direction. Likewise, on receipt of the out of alignment signal 92 (+), tension subsystem 84 will increase the air pressure through control port 86 (+) to the tensioner (pneumatic cylinder) 104. The increased tension or force on the (−) end of spindle 14 increases the tension of pad/belt 15 on roller 34 and will cause pad/belt 15 to move or shift to the 19 (+) direction.

In this embodiment, each tensioner, 102 and 104, further comprises, for example, a pneumatic four stage cylinder with a bore diameter of 2.5 inches manufactured by Starcyl Canada Inc. of Quebec in Canada. At 100 psi air pressure each pneumatic cylinder will transmit about 1880 lb/f. Additionally, the tension subsystem 84 further comprises a single pneumatic differential pressure control valve, using for example, a Dyval Model 2SP valve by Dynamic Valves Inc. (Dyval) of Palo Alto, Calif. The Dyval Model 2SP has two single-stage pressure control valves where each separate valve of the 2SP is an independent valve with common supply and return port. In this embodiment, the two valves connect out of phase to each other to produce a high gain pressure differential output in response to the out of alignment signals 90 (−) and 92(+).

The present invention describes an apparatus and method for aligning a pad and belt combination on a roller used in linear planarization for chemical mechanical polishing. An advantage of the present invention over prior linear polishers is that the present invention keeps the pad/belt aligned on the roller. An advantage of keeping the pad and belt aligned is that the linear polishing tool will apply an even planarization to the wafer. If the pad and belt go out of alignment, then uneven planarization of the wafer or even no planarization of the wafer will occur. In the worst case, the pad and belt could even come completely off of the rollers. The present invention comprises an alignment sensor that senses the alignment of the pad/belt, a tensioner that tensions the pad/belt on a roller, and a controller that controls the alignment of the pad/belt by controlling the tensioner.

We claim:

1. An apparatus for aligning a pad/belt on a roller of a linear polisher used in chemical mechanical polishing of a semiconductor, comprising:

a linear polisher with the pad/belt linearly carried by the roller;

an alignment sensor, said alignment sensor senses the alignment of the pad/belt on the roller;

a tensioner, said tensioner tensions the pad/belt; and a controller, said controller controls the alignment of the pad/belt on the roller by controlling said tensioner.

2. The apparatus of claim 1 wherein said controller further comprises:

a tension subsystem, said tension subsystem controls the tensioning said tensioner applies to the pad/belt; and an alignment subsystem, said alignment subsystem controls the alignment of the pad/belt on the roller.

3. The apparatus of claim 1 wherein said tensioner further comprises a stepper motor with a lead screw mechanism.

4. The apparatus of claim 1 wherein said tensioner further comprises a hydraulic cylinder.

5. The apparatus of claim 1 wherein said tensioner further comprises a pneumatic cylinder.

6. The apparatus of claim 1 wherein said alignment sensor further comprises an inductively coupled sensor.

7. The apparatus of claim 1 wherein said alignment sensor further comprises a laser sensor.

8. The apparatus of claim 1 wherein said alignment sensor further comprises a video sensor.

9. The apparatus of claim 1 wherein said alignment sensor further comprises an infrared sensor.

10. A system for aligning a pad/belt on a roller of a linear polisher used in chemical mechanical polishing of a semiconductor, comprising:

a linear polisher with the pad/belt linearly carried by the roller;

an alignment sensor, said alignment sensor senses the alignment of the pad/belt on the roller;

tensioning means for tensioning the pad/belt; and controller means for controlling the alignment of the pad/belt on the roller by controlling said tensioning means.

11. The system of claim 10 wherein said controller means further comprises:

tension controlling means for controlling the tensioning said tensioning means applies to the pad/belt; and alignment controlling means for controlling the alignment of the pad/belt on the roller.

12. The system of claim 10 wherein said tensioning means further comprises a stepper motor with a lead screw mechanism.

13. The system of claim 10 wherein said tensioning means further comprises a hydraulic means for providing tensioning.

14. The system of claim 10 wherein said tensioning means further comprises a pneumatic means for providing tensioning.

15. The system of claim 10 wherein said alignment sensor further comprises an inductively coupled sensor.

16. The system of claim 10 wherein said alignment sensor further comprises a laser sensor.

17. The system of claim 10 wherein said alignment sensor further comprises a video sensor.

18. The system of claim 10 wherein said alignment sensor further comprises an infrared sensor.

19. A method for aligning a pad/belt on a roller of a linear polisher used in chemical mechanical polishing of a semiconductor, comprising the following steps:

rotating the pad/belt about the roller of a linear polisher;

sensing the alignment of the pad/belt on the roller;

tensioning the pad/belt; and aligning the pad/belt on the roller by controlling said step of tensioning the pad/belt.

20. The method of claim 19 wherein said step of tensioning the pad/belt further comprises a stepper motor with a lead screw mechanism.

21. The method of claim 19 wherein said step of tensioning the pad/belt further comprises a hydraulic cylinder.

22. The method of claim 19 wherein said step of tensioning the pad/belt further comprises a pneumatic cylinder.

23. The method of claim 19 where said step of sensing further comprises an inductively coupled sensor.

24. The method of claim 19 where said step of sensing further comprises a laser sensor.

25. The method of claim 19 where said step of sensing further comprises a video sensor.

26. The method of claim 19 where said step of sensing further comprises an infrared sensor.

* * * * *

UNITED STATES PATENT AND TRADEMARK OFFICE

CERTIFICATE OF CORRECTION

PATENT NO. : 5,871,390

DATED : Feb. 16, 1999

INVENTOR(S) : Anil K. Pant, et al

It is certified that error appears in the above-identified patent and that said Letters Patent is hereby corrected as shown below:

On title page, item [75], change "Volodarski" to --Volodarsky--

Col. 7, line 32, "." after "64" should be --,--.

Signed and Sealed this

Seventh Day of September, 1999

*Attest:*

Q. TODD DICKINSON

*Attesting Officer*

*Acting Commissioner of Patents and Trademarks*